United States Patent [19]

Gertsch et al.

[11] Patent Number: 4,854,806

[45] Date of Patent: Aug. 8, 1989

[54] DEVICE FOR LOADING OR UNLOADING PAPER ROLLS ONTO OR FROM A ROLL STAND OF A WEB-FED ROTARY PRINTING PRESS

[75] Inventors: Peter Gertsch, Niederscherli; Arnold Kohler, Oberdiessbach, both of Switzerland

[73] Assignee: Maschinenfabrik Wifag, Switzerland

[21] Appl. No.: 26,277

[22] Filed: Mar. 16, 1987

[30] Foreign Application Priority Data

Mar. 18, 1986 [DE] Fed. Rep. of Germany ..... 3609086

[51] Int. Cl.[4] ..... B60P 3/00

[52] U.S. Cl. ..... 414/495; 414/589; 414/910; 414/911; 242/58.6; 242/79

[58] Field of Search ..... 414/401, 589, 495, 427, 414/908, 911, 910, 607; 242/58.6, 79; 248/132; 269/289 MR; 254/2 R, 89 H

[56] References Cited

U.S. PATENT DOCUMENTS

| | | | |
|---|---|---|---|
| 2,417,553 | 3/1947 | Jensen | 269/289 MR |
| 3,690,583 | 9/1972 | Herman | 242/78.1 |
| 4,131,206 | 12/1978 | Kawada et al. | 414/911 X |
| 4,161,253 | 7/1979 | Ralston et al. | 414/911 X |
| 4,253,792 | 3/1981 | Nishikawa | 414/589 |
| 4,415,304 | 11/1983 | Tripoli et al. | 414/589 |
| 4,460,135 | 7/1984 | Hirakawa et al. | 414/911 |
| 4,527,485 | 7/1985 | Lemaitre | 414/911 X |

FOREIGN PATENT DOCUMENTS

| | | | |
|---|---|---|---|
| 1940426 | 5/1970 | Fed. Rep. of Germany | 242/79 |
| 2136791 | 2/1973 | Fed. Rep. of Germany | 242/58.6 |
| 3402582 | 8/1985 | Fed. Rep. of Germany . | |
| 807603 | 1/1937 | France | 254/2 R |
| 70251 | 6/1981 | Japan | 242/58.6 |
| 174033 | 8/1986 | Japan | 414/910 |
| 126438 | 6/1928 | Switzerland | 242/58.6 |
| 697224 | 11/1979 | U.S.S.R. | 242/79 |
| 816774 | 3/1981 | U.S.S.R. | 414/749 |
| 893296 | 12/1981 | U.S.S.R. | 242/79 |
| 1237537 | 6/1986 | U.S.S.R. | 414/911 |
| 1444836 | 8/1976 | United Kingdom | 414/911 |

*Primary Examiner*—Robert J. Spar
*Assistant Examiner*—Donald W. Underwood
*Attorney, Agent, or Firm*—McGlew & Tuttle

[57] ABSTRACT

A traveling platform unit which is movable in the horizontal direction, for loading and unloading a printing paper on a roll stand. The roll stand has swivel arms and is part of a web-fed rotary printing press which uses the printing paper rolls. The traveling platform is equipped with lifting elements acting together in pairs, which permit aligning of the paper rolls with a paper roll bearing axle of the roll stand while allowing paper rolls of different diameters and widths to be brought for clamping between pairs of the swivel arms of the roll stand or to be removed from the swivel arms of the roll stand.

6 Claims, 4 Drawing Sheets

DEVICE FOR LOADING OR UNLOADING PAPER ROLLS ONTO OR FROM A ROLL STAND OF A WEB-FED ROTARY PRINTING PRESS

FIELD AND BACKGROUND OF THE INVENTION

The invention relates in general to printing presses and in particular to a new and useful device for loading and unloading paper rolls of a roll stand equipped with swivel arms of a web-fed rotary printing press using a traveling platform unit equipped with a lifting device and movable in the horizontal direction.

A similar loading and unloading device is shown, for example, in German OS 34 02 582. For loading the roll stand, a new paper roll is brought onto a lift device of a traveling platform unit built as a lift platform, the traveling platform unit being outside the area of the roll stand. The traveling platform unit then drives in a horizontal direction between the swivel arms of the roll stand, whereupon the lift platform lifts the paper roll to the required height. The paper roll clamping devices on the swivel arms can then reach into the central core opening of the paper rolls. The paper rolls, which can be very heavy depending on the dimension, must, for this insertion, be aligned exactly between the swivel arms of the roll stand, so that the paper roll clamping device can reach into the core opening of the paper roll. This aligning is still frequently done by hand, which requires operating personnel while being tied to a great deal of energy expenditure. Automatically building the paper rolls into the roll stand is not possible. Furthermore, on changing production as well as on continuous processing of the paper web, a residual paper roll of given diameter results, which before reloading the roll stand with a new paper roll must be removed from the roll stand.

Since in the head of the swivel arms of the roll stand, in addition to the mounting of the paper roll clamping device, additional apparatus like a shift mechanism of the paper roll clamping device, paper roll breaks, clamping device at the paper roll clamping journal, regulated drive of the paper roll clamping journal, are located, this head, understandably is of considerable size. And, since the swivel arms of the roll stand have to be able to accept paper rolls of different widths because of the different widths of the paper web, the swivel arms are constructed movable. The lift platform of the traveling platform unit, however, has to be constructed in such a way, that it can feed the widest paper roll or that a small paper roll can be processed on the left as well as on the right margin of the press.

With the prior traveling platform units with lift platforms only material up to a certain size, depending on the dimensions of the head of the swivel arm of the roll stand, can be lifted up to the paper roll bearing axle. Residual rolls of small diameter would, on unloading, have to be dropped a given distance onto the lift platform on unloading, which can lead to damage to the paper rolls and lead to disturbances during automatic roll changing. On the other hand, residual rolls, which have a relatively small diameter and which still need to be processed, can no longer be brought automatically between the swivel arms of the roll stand.

SUMMARY OF THE INVENTION

The invention provides a device, which makes it possible to avoid the above mentioned disadvantages, and which enable the alignment of paper rolls on the traveling platform unit as well as loading and unloading residual rolls with small diameter with all of these processes being automated.

According to the invention, in the lift device of the traveling platform unit lift elements are provided, which on both sides of a line parallel to a paper roll bearing axle of the roll stand act together in pairs, and can be raised and lowered. The ends of the lift elements which face the paper rolls, are equipped with support rollers, which in the lower resting position of the lift elements, can be totally sunk into the traveling platform unit. The lift elements have at least one working position for lifting in and out and aligning paper rolls of different diameters.

The feature according to the invention, namely that the paper rolls can be aligned in the direction of the axis of the roll stand and that residual rolls with a small diameter can be clamped securely into and out of the roll stand, ensures the precision required for automatic operation.

An advantageous embodiment of the invention includes providing lift elements located on a lift platform which lift platform is arranged on a traveling platform or trolley unit and can be raised and lowered by lifting mechanism on the traveling platform unit. Because of this, lift elements with only two operating positions can be used, which can be set for fixed stops. One of the working positions serves for aligning the paper rolls, the other for lifting residual rolls with small diameters. Because a lift element works against the stop, a synchronizing device is not necessary. In addition, the height of the lift can be considerably smaller, since the actual lifting and lowering of the paper rolls takes place from the lift platform.

Since in addition to paper rolls having maximum width, paper rolls of three fourth, half and one fourth width need to be processed, the position of which must be appropriately adjusted, four pairs of lift elements are advantageously employed which cover the usual variations of paper roll widths. By selectively including or excluding the pairs of lift elements required for a particular operation process, ensurance is given that the paper rolls are brought between the swivel arms of the roll, stand which have been moved into the appropriate position.

A further advantageous model of the lift elements includes two final positions of the support rollers which are set by a spring element and with fixed stops. If the support rollers are unstressed, they are pushed into the front positions. On approaching the paper roll, the support rollers are pushed against the resiliency of the spring elements into the lower position against the lower stop and a limit switch is activated, which stops the lifting motion of the lift elements. With this arrangement, paper rolls with different diameters can be handled without presettings and without any problem.

In a further advantageous construction of the lift elements their ends facing away from the paper rolls are connected with the lift platform by an articulation and thus the first motion, in lifting paper rolls, includes swiveling the lift elements, and subsequently the arms, with the support rollers mounted on them, can be drawn out. With this arrangement, a small structural height of the lift platform is achieved while allowing sufficient room for a wagon which runs on guide rails of the lift platform. Due to the possible oblique drawing out of the lift arms, a secure manipulation of the rolls is ensured.

Accordingly it is an object of the invention to provide an apparatus for loading and unloading a paper roll on a roll stand of a web-fed printing press which has spaced apart pairs of pivotal support arms carrying a paper roll bearing axle for the paper rolls and which comprises a traveling platform which is movable toward and away from the roll stand below the support arms and which has a pair of lifting elements mounted thereon with extensible lifting parts having support rollers which are arranged so that they extend obliquely toward the paper roll they are to lift from each side of the center line of the paper roll bearing axle and wherein the lifting elements are retractable into the platform and extensible and retractable to permit the lifting of the paper rolls of different diameters into and out of operable engagement with the bearing axles of the roll stands support arms.

A further object of the invention is to provide an apparatus for loading and unloading a paper roll on a roll stand which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
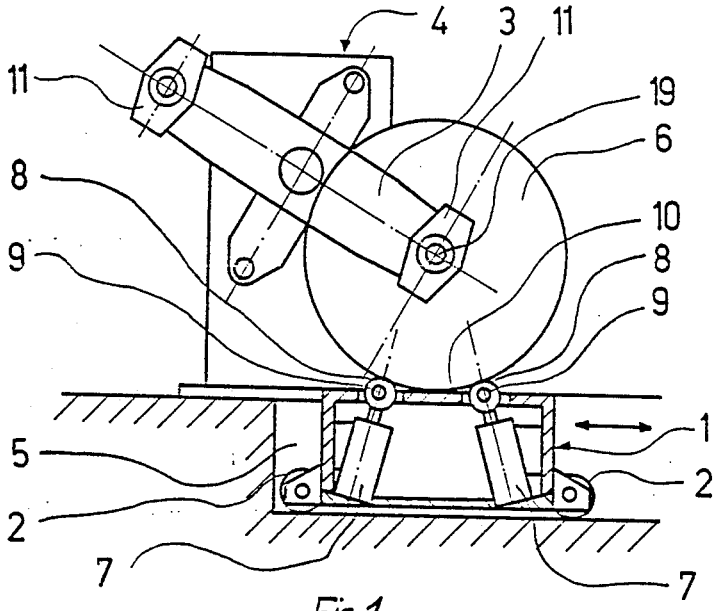
FIG. 1 is a transverse sectional view of a traveling platform unit with lift elements, which are in the paper roll aligning position and constructed in accordance with the invention.

Referring to the drawings in particular the invention embodied therein comprises an apparatus for loading and unloading a paper roll 6 on a roll stand 4 of a web fed printing press which has pairs of pivotal support arms 3 with a paper roll bearing axle 19 for a swivel arm head 11 for each of the paper rolls. The apparatus comprises a traveling platform 1 which is movable toward and away from the roll stand below the pivotal arms 3 and carries a pair of oppositely acting lifting elements 7 having support rollers 9 at their outer extensible end which act along radial lines against the roll to support it for engagement or removal from arms 3.

In FIG. 1 a traveling platform unit generally designated 1 is schematically represented, which rests on rollers 2 on a trackway 50 of a paper roll mounting apparatus 52. The rollers 2 allow movement of the traveling platform unit 1 into and out of an area adjacent a roll stand 4 below the swivel arms 3. The traveling platform unit 1 travels in an excavation 5 having the trackway 50, which means, that loading a paper roll 6 can take place at a base level or ground levels 10. For loading, lift elements 7, which, for example, are hydraulic cylinders or rotatable threaded lifting spindle elements, and which are each mounted on the traveling platform unit 1 at a slightly oblique angle, are shown in a slightly extended position above their lowest position. The lifting elements 7 carry support rollers 8 which pivot on an axle 9 on the ends of respective lift elements 7 which face the paper rolls. In an inoperative position they do not project beyond the surface 10 of the traveling platform unit 1. As soon as the paper roll 6 is between the paired lift elements 7,7 outer telescopic arm portion 12 are drawn out or telescopically extended into the position shown in FIG. 1. The support rollers 8 lift the paper roll 6 from the surface 10 of the traveling platform unit 1 and align the paper roll simultaneously along a swivel arm axis and between externally spaced pairs of the swivel arms 3. The traveling platform unit 1 can now be moved between the pairs of swivel arms 3 of the roll stand 4, the arms having been adjusted to the width of the paper roll 6 in the ways known. Clamping journals (not shown) are located in a head 11 of each swivel arm and are inserted into core openings of each paper roll 6 and grip and support a paper roll 5.

Figure 2:
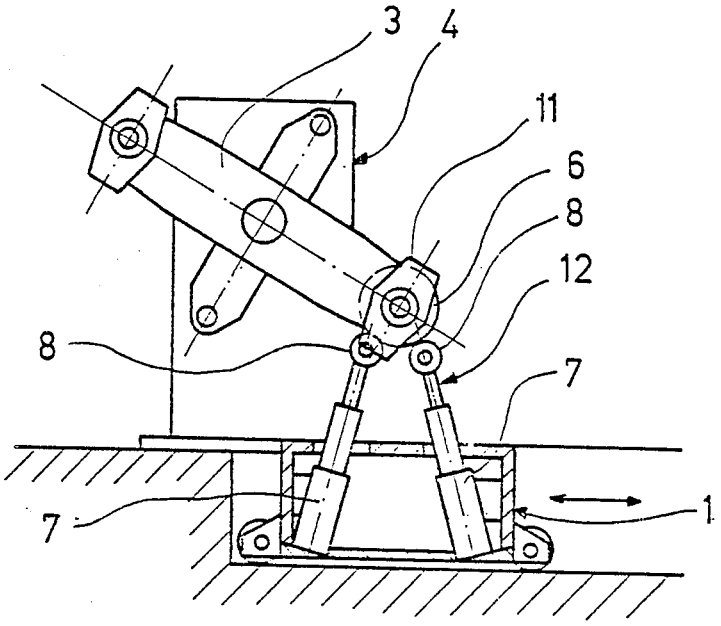
FIG. 2 is a view similar to FIG. 1 of another embodiment with a traveling platform unit with telescoping lift elements for loading and unloading paper rolls of small diameter.

FIG. 2 shows a paper roll 6 with such a small diameter, that the heads 11 of the swivel arms 3 of the roll stand 4 project beyond the paper roll surface. The lift elements 7 are shown in a drawn out position 12 in FIG. 2. The support rollers 8 of the lift elements 7 support the paper roll 6, so that the clamping journal can be drawn back into the head 11 of the swivel arms 3 to release the paper roll 6. Lowering of the lift elements 7 allows the paper roll to be deposited on the traveling platform unit 1. The motions of the lift elements 7 must be synchronized in the known matter, so that the paper roll to be moved does not become slanted.

Figure 3:
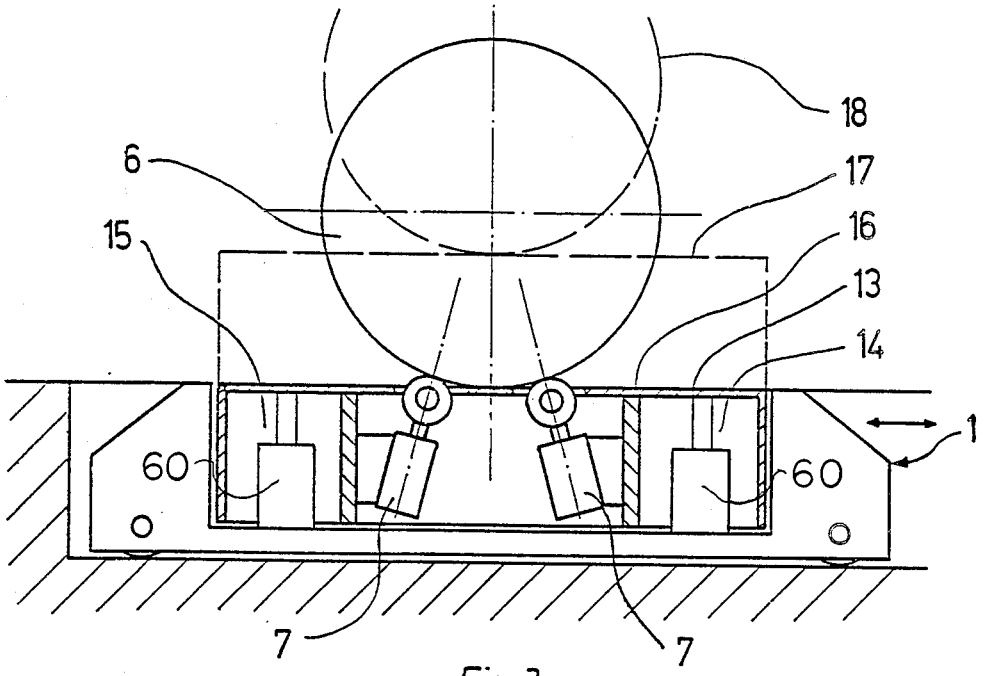
FIG. 3 is a view similar to FIG. 1 of another embodiment with a traveling platform with a lift platform, on which the lift elements are arranged.

The traveling platform unit 1 in FIG. 3 has an additional lift platform 13 which can be raised and lowered. The known, mechanism 60 moving the lift platform 13 is accommodated in spaces 14 and 15 and, e.g. comprises telescopic piston and cylinders carried by the platform 13 which press against the platform 1. The lift elements 7 are firmly connected to the additional lift platform 13. With this embodiment, the lift elements 7 can be built simpler. Only the positions "down", "up", and "align" are possible, which can be fixed with stops, which are not shown here. The height of the lift also is smaller, because the paper roll 6 deposited on the lift platform 13 of the traveling platform unit 1 can be lifted with the lift platform 13 until the surface 16 of the lift platform 13 practically touches the heads 11 of the swivel arms 3. In FIG. 3, the raised position 17 with the lifted paper roll 18 is indicated in dashed lines. If paper rolls with small diameters have to be moved between the swivel arms of the roll stand, the lift cylinders 7 are brought into their upper position, the lift platform 13, subsequently, begins operating. For aligning a paper roll 6 with large diameter, the lift elements 7 are drawn out only to a small extent, until the support rollers 8 lift the paper roll 6 from the surface 16 of the lift platform 13.

Figure 4:
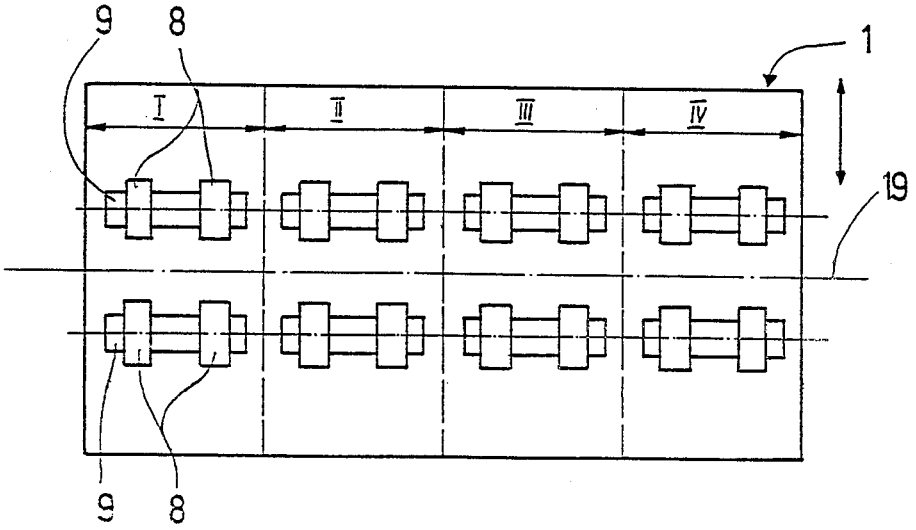
FIG. 4 is a top plan view of a possible arrangement of the lift elements for each of the embodiments with their support rollers arranged over the entire width of the traveling platform or lift platform.

FIG. 4 shows a possible arrangement of the lift elements over the entire width of the traveling platform unit 1. The traveling platform unit 1 is, corresponding to the possible paper roll widths, divided into four sectors I to IV, and, in particular, transverse to the paper roll axis 19. Each of the sectors I to IV has two not visible lift elements arranged symmetrically to the axis 19 of the paper roll. On each of the lift elements an axle 9 is mounted which supports one pair of support roller 8 each, which pivot on the axle 9. The axles 9 are protected against twisting, so that they are always aligned parallel to the paper roll axis 19. With this arrangement and division of the traveling platform unit 1, paper rolls, which have maximum width determined by the press, or are three fourth, half or one fourth wide, can be lifted into and from the roll stand. The lift elements can be included or excluded in pairs depending on the width of the paper roll and the requirement.

Figure 5:
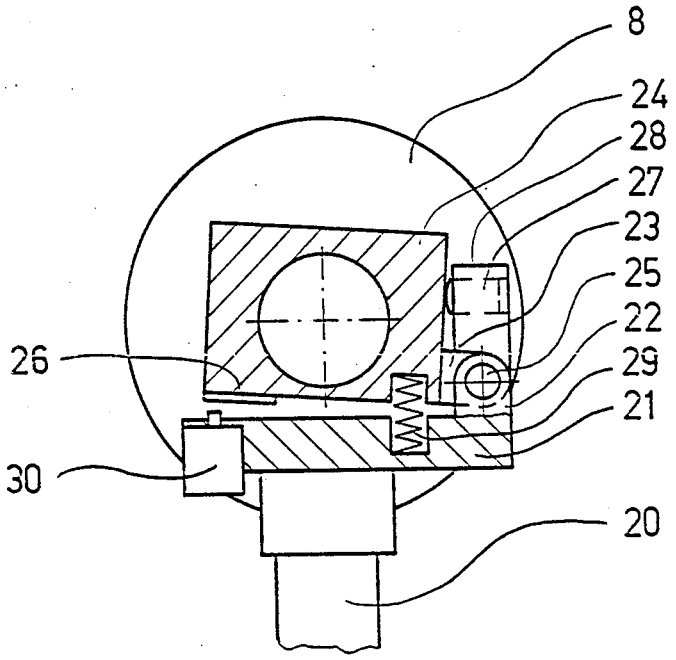
FIG. 5 is an enlarged partial sectional view of a resilient connecting member of a lift element.

In order to prevent the support rollers 8 from driving into the paper roll 6 and thus prevent damage to the paper roll 6 or the storage in the swivel arms 3 while lifting off a paper roll 6, which is held in the roll stand 4, the support rollers 8, are spring supported, as shown in FIG. 5. A moving part 20 of the lift element 7 is fastened to a plate 21, which has cogs 22 on one side. These cogs 22 form with tappets 23 of an axle support 24 an articulation, the rotational center of which lies in the center of an axle 25. The swiveling motion, which the the axle support 24 can complete, is limited by the stop surface 26 and the plate 21 and the adjustable stop pin 27, which is located on a bolt 28 firmly connected to the plate 21. In the axle support 24, the axle 9 carrying the support rollers is mounted. A spring 29, inserted between plate 21 and axle support 24 in the opening provided for it, presses the axle support 24 against the stop pin 27. If during drawing out of the moving part 20 the support rollers 8 meet the paper roll, the spring 29 is pressed together until the stop surface 26 comes to rest on the plate 21. Through this action a limit switch 30 set into the plate 21 is activated, its transmitted signal is used for stopping the motion of the moving part 20.

Figure 6:
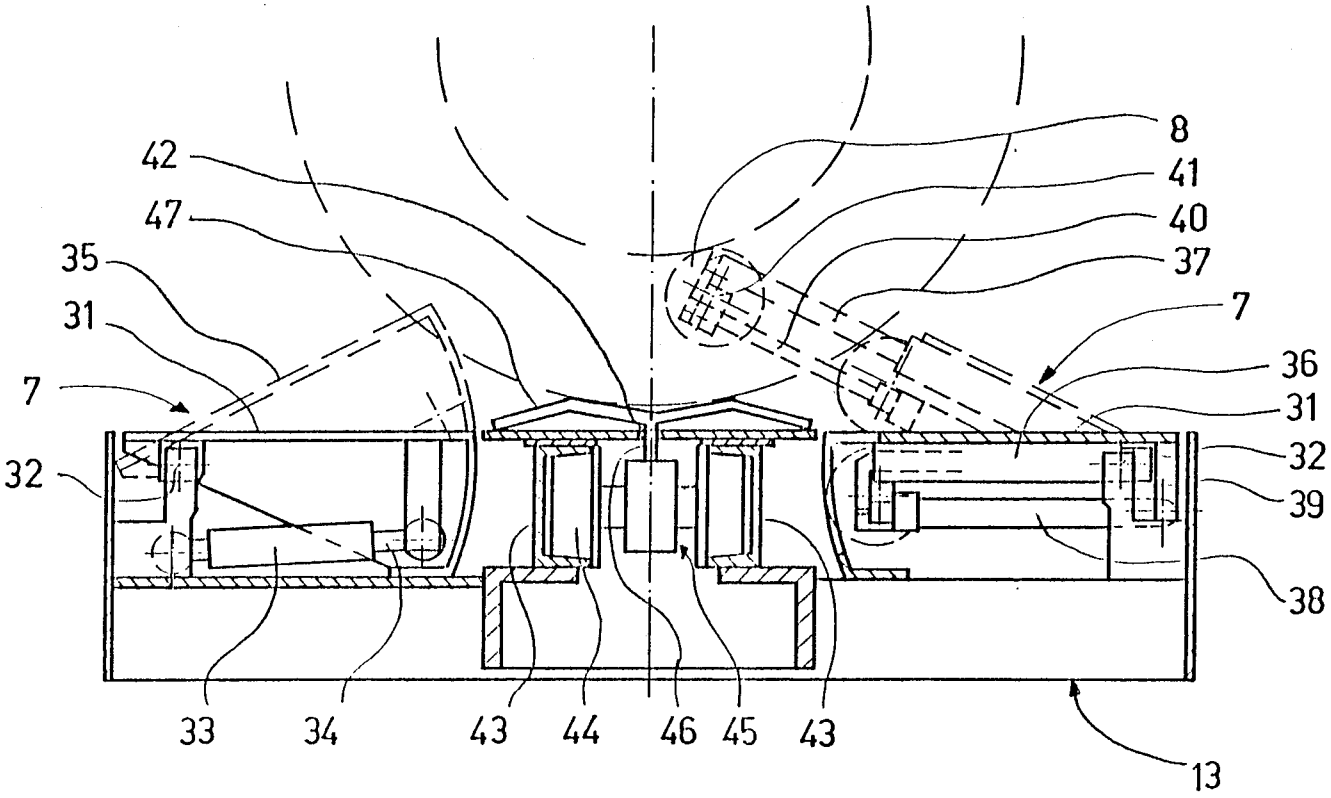
FIG. 6 is a partial sectional view similar to FIG. 1 of another embodiment of a lift element, which is swivelable and is arranged on the traveling platform unit of the lift platform.

In FIG. 6, a lift platform 13 is represented which is arranged on a traveling platform unit, not shown here. The lift platform 13 is provided with symmetrically arranged lift elements 7, the mechanism of operation of which takes place in two parts. The lids 31 of the lift platform 13 are connected with the lift platform 13 rotatable around axis 32. A lift cylinder 33, the end of which is articulated with the lift platform, is jointed to the lid 31 with its piston rod 34. This makes it possible to bring the lid 31 into its raised position 35 by extending the piston rod 34, as shown in dashed lines on the left hand side of FIG. 6. The swivel motion is limited by stops (not shown). On the underside of the lid 31, a friction bearing sleeve 36 is fastened, into and out of which a slidable section 37 can be moved. The section 37 is driven by a lifting cylinder 38, which at its end is jointed to a lug 39 of the lid 31.

The piston rod 40 is connected with a carrier 41, which is fastened at the section 37. The carrier 41 ends on both sides in an axle 9, on which the support rollers 8 pivot. To lift and align the paper roll 6, both lids 31 are swung out. Subsequently, the support rollers 8 can be drawn out linearly, whereby the paper roll 6 is raised. Lowering takes place in reverse sequence.

Between the two lift elements, the lift platform 13 has a slot 42. Below it, on both sides, U sections 43 are firmly connected with the lift platform. Into these U-profile sections 43, which serve as guide rails, a wagon 45 provided with guide rollers 44 can be set, the wagon projecting with a bar 46 through the slot of the lift platform 13, and on which the correspondingly shaped loading surface 47 for receiving a paper roll 6 is fastened. In this way, a paper roll can be directly driven by a wagon 45 from a preparatory site to the lift platform 13 of the traveling unit 1, from where it is lifted into the roll stand of a printing press. In the same manner, rest rolls can be driven from the roll stand directly to a rest roll storage.

The described device can be developed from being operated practically manually to the completely automated loading and unloading of roll stands in printing presses.

While specific embodiments of the invention have been shown and described in detail to illustrate the application of the principles of the invention, it will be understood that the invention may be embodied otherwise without departing from such principles.

What is claimed is:

1. An apparatus for loading and unloading a paper roll on a roll stand of a web-fed printing press, comprising, a support floor, a roll stand mounted on said support floor and having a pair of spaced-apart pivotal support arms, a roll-bearing axle supported between said arms, an excavation in said floor underlying said support arms of said roll stand and extending outwardly therefrom, a travelling platform movable in said excavation toward and away from said roll stand and into a loading position below said support arms, a pair of lifting elements mounted on said travelling platform so as to extend radially obliquely with respect to each other, each lifting element including a telescopic portion which is extensible and retractible, each telescopic portion having an outer end with a support roller which may be positioned below a paper roll engaged on said paper roll supporting arms and being extensible in directions radial to the axis of said paper roll to engage the paper roll and lift it above the ground, said travelling platform being movable beneath the paper roll when it is held between the support arms and when said extensible portions of said lifting elements are retracted, said lifting elements including an outer extensible part having a plate thereon, a roller axle support pivoted to said plate and carrying an axle of said rollers, stop means for limiting the pivotal movement of said axle support.

2. A device according to claim 1, wherein said traveling platform carries a plurality of pairs of lift elements arranged in axial spaced relationship to said roll-bearing axle.

3. A device according to claim 1, wherein said lifting platform has a plurality of spaced apart pairs of lifting elements arranged across its transverse direction below and in respect to the paper roll and wherein selected ones of said lifting elements are actuated in dependence upon the size of the paper roll to be lifted.

4. A device according to claim 1, including means supporting adjustable stop elements on an least one side of said axle support for limiting the movement of said axle support in at least one pivotal direction and including a limit switch arranged in path of movement of the axle support in an opposite rotational direction for controlling extensible movement of said lifting device.

5. A device according to claim 1, wherein said lifting elements include a drive device connected to said lifting elements, a platform being supported on said travelling platform and being raisable and lowerable by said drive device.

6. An apparatus for loading and unloading a paper roll on a roll stand of a web-fed printing press, comprising, a support floor, a roll stand mounted on said support floor and having a pair of spaced-apart pivotal support arms, a roll-bearing axle supported between said arms, an excavation in said floor underlying said support arms of said roll stand and extending outwardly therefrom, a travelling platform movable in said excavation toward and away from said roll stand and into a loading position below said support arms, a pair of lifting elements mounted on said travelling platform so as to extend radially obliquely with respect to each other and to the axle of the roll stand, each lifting element including a telescopic portion which is extensible and retractible, each telescopic portion having an outer end with a support roller which may be positioned below a paper roll engaged on said paper roll supporting arms and being extensible in directions radial to the axis of said paper roll to engage the paper roll and lift it above the ground, said travelling platform being movable beneath the paper roll when it is held between the arms and when said extensible portions of said lifting elements are retracted, guide rail means carried by said travelling platform, a wagon having wheels engaged on said guide rail means, said wagon having a surface for receiving paper rolls for transporting said rolls, said lift elements carried by said travelling platform, being arranged on each side of said wagon.

* * * * *